US005349881A

United States Patent [19]

Olorenshaw, deceased et al.

[11] Patent Number: 5,349,881

[45] Date of Patent: Sep. 27, 1994

[54] MULTI-AXIAL CENTERING SPRING MECHANISM

[76] Inventors: George M. Olorenshaw, deceased, late of Maple Ridge; by Christine J. Olorenshaw, executor, 11810 Stephens Street, Maple Ridge, B.C., both of Canada, V2X 6S3

[21] Appl. No.: 56,724

[22] Filed: May 3, 1993

[51] Int. Cl.[5] ..... G05G 9/00

[52] U.S. Cl. ..... 74/471 XY; 200/6 A; 267/150

[58] Field of Search ..... 74/471 XY; 267/50; 200/6 A

[56] References Cited

U.S. PATENT DOCUMENTS

| | | | |
|---|---|---|---|
| 2,929,258 | 3/1960 | Mackway | 74/471 |
| 3,744,335 | 7/1973 | Karlsson et al. | 74/471 XY |
| 4,124,787 | 11/1978 | Aamoth et al. | 200/6 A |
| 4,356,357 | 10/1982 | Fisher | 200/6 A |
| 4,375,631 | 3/1983 | Goldberg | 338/128 |
| 4,459,578 | 7/1984 | Sava et al. | 74/471 XY |
| 4,639,668 | 1/1987 | Petit et al. | 74/471 XY |
| 4,756,205 | 7/1988 | Dickinson | 74/471 XY |
| 5,107,080 | 4/1992 | Rosen | 200/6 A |
| 5,160,918 | 11/1992 | Saposnik et al. | 74/471 XY |

FOREIGN PATENT DOCUMENTS

| | | | |
|---|---|---|---|
| 1104834 | 4/1961 | Fed. Rep. of Germany | 74/471 XY |
| 518874 | 3/1955 | Italy . | |
| 2107029 | 3/1983 | United Kingdom . | |

*Primary Examiner*—John T. Kwon

*Attorney, Agent, or Firm*—Shlesinger Arkwright & Garvey

[57] ABSTRACT

A mechanism suitable for a control lever such as a joy stick has two mutually perpendicular axes of rotation which provide movement in two planes. At least two close wound coil springs form a set and a set of springs is provided for each plane. The springs deflect when a force is applied on the control lever but return to a center position when the force is released. The mechanism avoids the use of shafts.

7 Claims, 2 Drawing Sheets

MULTI-AXIAL CENTERING SPRING MECHANISM

TECHNICAL FIELD

The present invention relates to a mechanism suitable for a control lever such as a "joy stick" that is self centering in more than one plane. More specifically, the present invention provides a self centering spring mechanism for a joy stick control or a self centering mounting arrangement that does not require rotating shafts.

BACKGROUND ART

Mechanisms which provide spring centering forces along two or more axes of motion are known. The applications for such mechanisms include joy stick control devices, scanning mechanisms, plotting devices, servo control mechanisms and other applications where delineation of centering forces applied to specific axes is desirable. Other applications include multiplanar mounting platforms for dish antennas and the like. Such platforms have linear drive motors that change the position of the platform upon demand. The self centering feature permits the platform to center itself when the linear drive motors are not activated.

Existing types of joy stick control devices include gimbal mountings wherein two mutually perpendicular and intersecting axes of rotation are provided and control levers are generally provided on the axes of rotation. In some mechanisms springs are combined with rotational shafts to provide a centering mechanism. However, whenever shafts are used, bearings are needed to ensure ease of rotation of the shafts and this can be a cause of frictional wear and added complexity in manufacturing.

DISCLOSURE OF INVENTION

The present invention relates to a mechanism which has two mutually perpendicular axes of rotation thus giving free angular movement in two planes. The movement is provided by sets of at least two springs in each plane, the springs being close wound coil springs. A force applied perpendicular to the axes of rotation deflects the springs and when the force is removed then the springs automatically return to their close wound condition. Thus a lever or control stick returns to its neutral position.

In yet another embodiment, a rotational axis may be added to the two mutually perpendicular axes. In a further embodiment the two mutually perpendicular axes may be intersecting.

The mechanism described throughout the specification may be used in association with sensing devices or switches that show deflection in both the two axes of rotation and thus provide a signal for a control mechanism. The mechanism also includes multiplanar mounting platforms with linear drive motors or the like to move the platforms.

Joy stick controls may be used for example in the control of wheelchairs, computer games and the like. In industrial applications joy stick controls may be applied to heavy equipment such as mechanical excavating equipment, backhoes, loaders, etc. These examples are but a few of the many applications that use control systems in two planes.

The present invention provides a multi-axial centering spring mechanism comprising a first set of at least two close wound coil springs, in line and coupled together in a first plane, mounted on a base means; a yoke having a first cross piece attached to the first set of springs, such that force applied to the first cross piece, transverse to the first plane, deflects the yoke relative to the base means, and the first set of springs causes the yoke to return to a center position when no force is applied; the yoke having a second cross piece transverse to the first cross piece; a second set of at least two close wound coil springs, in line and coupled together in a second plane, mounted on the second cross piece; a tie bar attached to the second set of springs, such that force applied to the tie bar, transverse to the second plane, deflects the tie bar relative to the yoke, and the second set of springs causes the tie bar to return to a center position when no force is applied, and lever means connected to the tie bar for applying force in the first plane and the second plane.

BRIEF DESCRIPTION OF DRAWINGS

In drawings which illustrate embodiments of the present invention.

MODES FOR CARRYING OUT THE INVENTION

Figure 1:
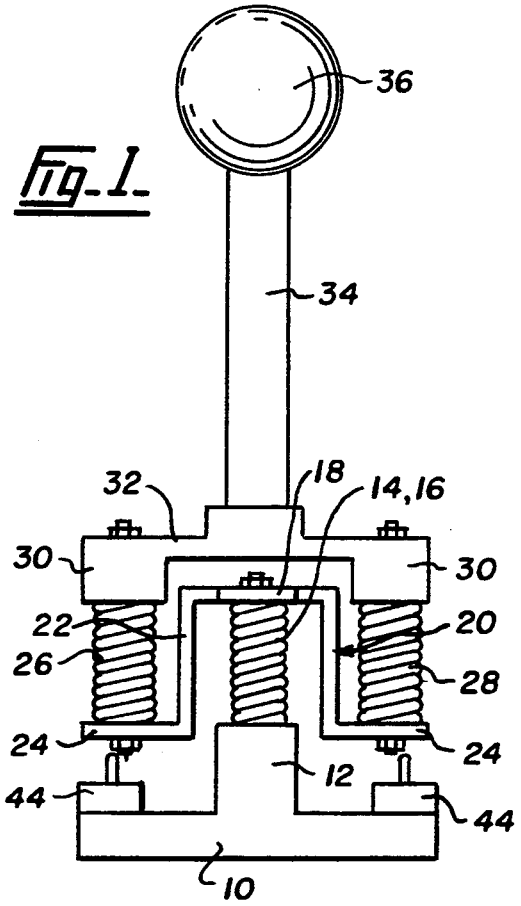
FIG. 1 is a side elevational view showing one embodiment of a multi-axial centering spring mechanism according to the present invention.
Figure 2:
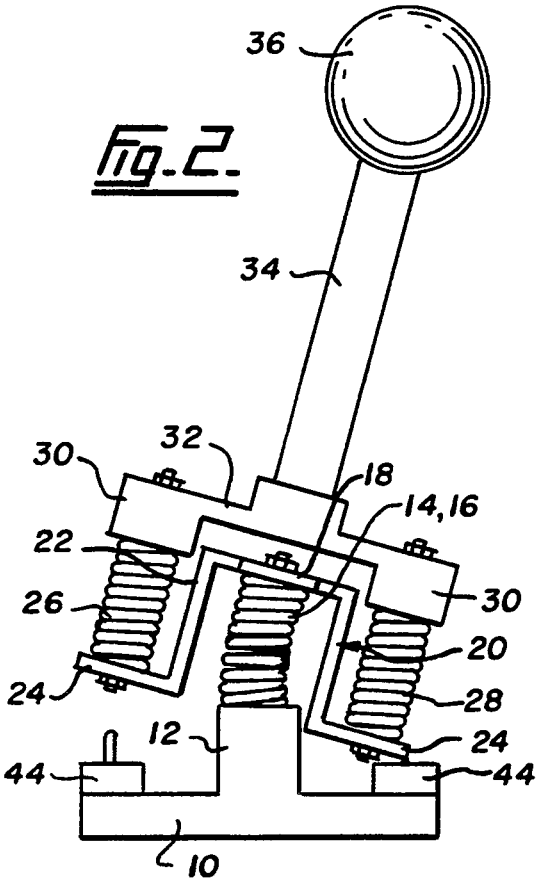
FIG. 2 is a side elevational view showing the centering spring mechanism disclosed in FIG. 1 with a force applied in a first plane.
Figure 3:
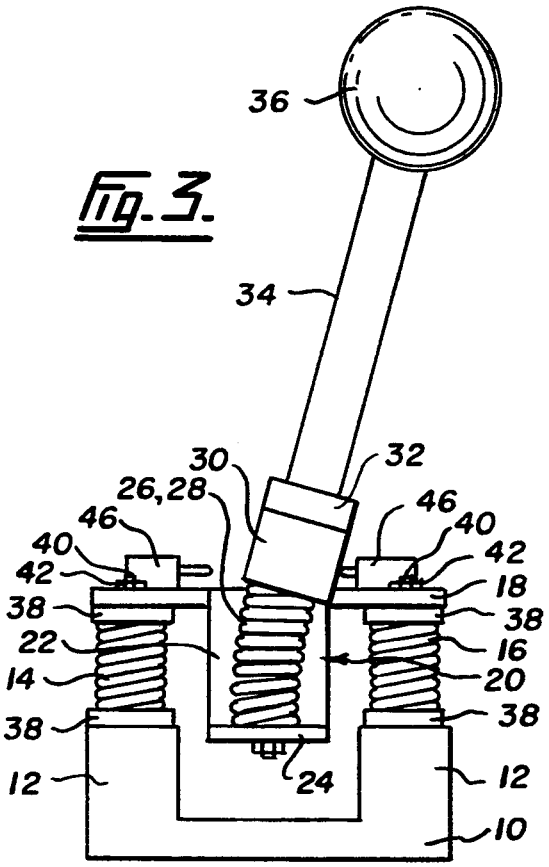
FIG. 3 is an end elevational view showing the centering spring mechanism disclosed in FIGS. 1 and 2 with a force applied in a second plane.

One embodiment of a multi-axial centering spring mechanism is shown in FIGS. 1 to 3 which has a base 10 which is substantially square having two raised portions 12 at the center of two opposing sides of the base 10 upon which are mounted two close wound coil springs 14,16. These first set of springs 14,16 are vertically attached at their bases to the raised portions 12. The tops of the first set of springs 14,16 are attached to a first cross piece 18 of a yoke 20 as is best illustrated in FIG. 3. The yoke 20 has a cross configuration with angle portions 22 that extend down on each side of the first cross piece 18 to form a second cross piece 24 at right angles to but in the same plane as the first cross piece 18. The base of the second cross piece 24 is at substantially the same level as the surface of the raised portions 12 of the base 10 and a second pair of close wound coil springs 26,28 are attached at their bases, in line on the second cross piece 24 but oriented at approximately 90° to springs 14,16.

The tops of the second set of springs 26,28 are attached to two mounting surfaces 30 of a tie bar 32. In the center of the tie bar 32, a control lever 34 or joy stick is mounted terminating in a knob 36. The control lever 34 is positioned at the point of intersection or mid-point between the planes of the first set of springs 14,16 and the second set of springs 26,28.

FIG. 3 shows the spring 16 having top and bottom caps 38 which grip the top and bottom of the spring. The bottom cap 38 is connected to the raised portion 12 by means of an internal bolt fitting into a tapped hole in the base 10, and the top cap 38 has a bolt 40 with a nut 42 that holds the cap 38 and hence the spring 16 in place, thus the spring 16 is firmly positioned and held between the base 10 and the first cross piece 18. The mounting arrangement between the other springs is not shown in detail but is similar to that shown in FIG. 3. In another embodiment, the caps 38 and bolts 40 shown in FIG. 3 are replaced with internal holding devices such as inserts threaded into the springs to grip the top and the bottom of the springs and hold them firmly against the mounting surfaces.

As shown in FIGS. 1 and 2, two reed switches 44 are shown positioned on each side of the base 10 such that when the second cross piece 24 deflects downwards, as shown in FIG. 2, on either one side or the other, the switch 44 is contacted by the second cross piece 24 and is activated to provide a signal for a control mechanism. Multi-position switches may be provided for different positions of the second cross piece 24. Similarly, as shown in FIG. 3, two further reed switches 46 are provided mounted on the first cross piece 18 and are contacted by the tie bar 32 when it is deflected to one side or the other about the second set of springs 26 and 28. Whereas reed switches are illustrated, it will be apparent that many different types of sensing devices such as switches or potentiometers may be used either to show direct movement or to show partial movement in the two planes. Thus, movement of the control lever 34 in any direction results in activating a switch or potentiometer to provide signals suitable for controlling purposes. The sensing devices do not form part of the present invention and many different types of sensing devices are known in the prior art and may be used with the mechanism disclosed herewith. Furthermore, the position of the sensing devices need not be limited to that shown in the drawings, any suitable location that detects movement in both planes is acceptable.

In another embodiment, the reed switches may be replaced by linear actuators, hydraulic cylinders, solenoids, linear drive motors or other types of power mechanism, which provide a force to move the first cross piece 18 and the second cross piece 24. A platform replaces the control lever shown in the drawings, and the platform is moved by the power mechanism. When the power mechanisms are deactivated, then the springs center the platform.

Figure 4:
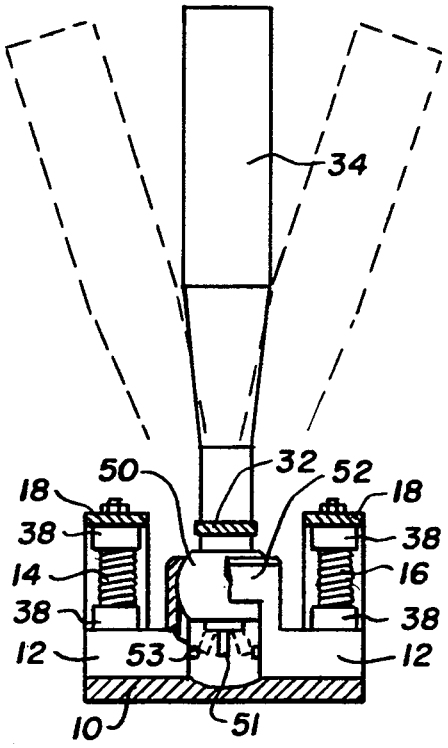
FIG. 4 is a detailed end sectional view showing another embodiment of a centering spring mechanism with a ball connected to the control lever.

Another embodiment of a control lever arrangement is shown in FIG. 4 wherein the control lever 34 is connected to the tie bar 32 and has beneath the tie bar a ball 50 that rotates in a cage 52 forming part of the base 10. The ball 50 floats within the cage 52 and the cage provides a restriction so that the movement of the control lever 34 is restricted by the cage, but the ball 50 can rotate in any direction. In one embodiment a pin 51 extends from the lower end of the control lever 34 integral therewith and below the ball 50. A restriction ring 53 about the pin 51 restricts the movement of the control lever 34 as shown in FIG. 4. The restriction ring 53 is supported from the base 10 and may have a round aperture, or alternatively may have an aperture to suit the movement of the control lever for a particular application. This restriction provides a safety feature preventing the springs being distorted or provides a greater precision when desired.

In operation when the control lever 34 is moved in one plane as illustrated in FIG. 3, a force is applied to the control lever 34 and the tie bar 32 is displaced deflecting the second set of springs 26,28. In view of the fact that the springs 26,28 are tightly attached to the mounting surfaces 30 of the tie bar 32 and also the second cross piece 24 of the yoke 20, then only the springs 26,28 deflect and they deflect in a single plane or axis. The control lever 34 may be moved left or right and when released the springs 26,28 return the control lever 34 to the central position.

If the control lever 34 is moved in a perpendicular plane, as shown in FIG. 2, then the yoke 20 is displaced and the first cross piece 18 deflects the first set of springs 14,16. As these springs 14,16 are tightly attached to the first cross piece 18 and to the raised portions 12 of the base 10, the yoke 20 is only displaced about the axis of the second or perpendicular plane in line with the first set of springs 14,16. Any intermediate movement of the control lever 34 deflects all four springs in both planes. As soon as the control lever 34 is released, the first and second sets of springs 14,16,26,28 return the control lever 32 to a central position which is at the mid-point of the intersecting axes. The springs themselves react to always maintain an upright position and thus ensure that the control lever 34 is upright.

Figure 5:
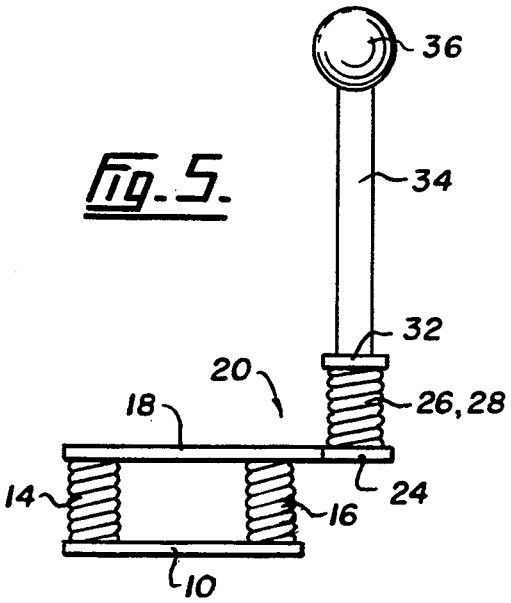
FIG. 5 is a side elevational view showing yet another embodiment of a multi-axial centering spring mechanism.
Figure 6:
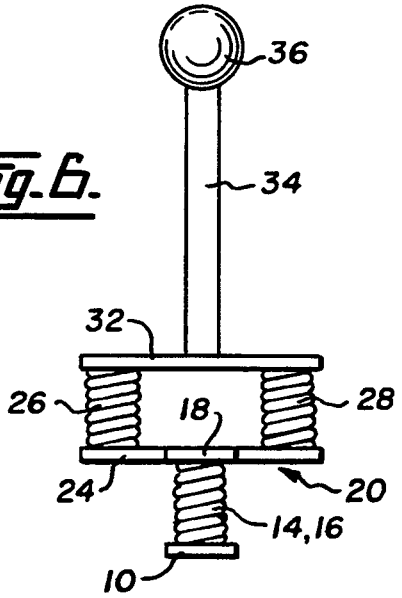
FIG. 6 is an end elevational view showing the centering spring mechanism of FIG. 5.
Figure 7:
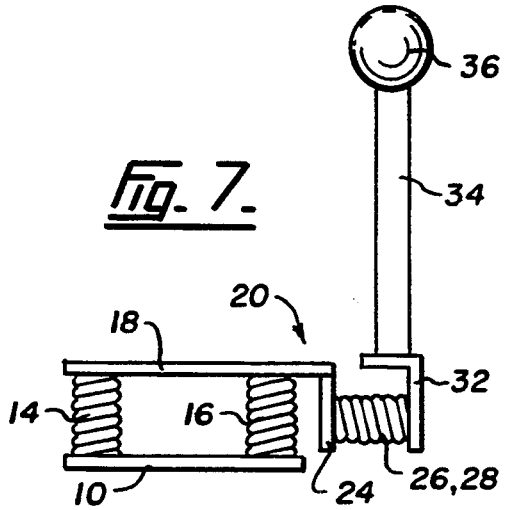
FIG. 7 is a side elevational view showing a further embodiment of a multi-axial centering spring mechanism.
Figure 8:
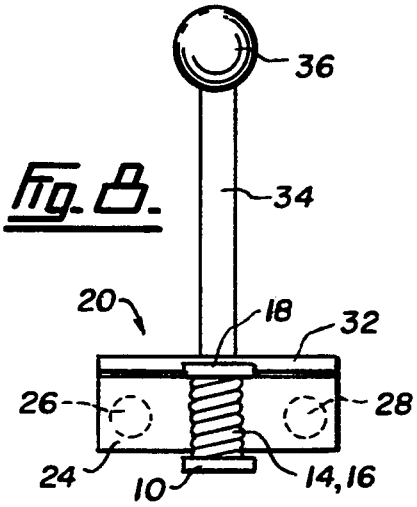
FIG. 8 is an end elevational view showing the centering spring mechanism of FIG. 7.

In another embodiment as shown in FIGS. 5 and 6, the two rotating axes do not intersect in a cross formation. The first set of springs 14,16 are mounted on a base 10 and at the top support the yoke 20 which is T-shaped rather than cross shaped. The first cross piece 18 extends across to join with the second cross piece 24 on which are mounted the second set of springs 26,28. This second set of springs 26,28 has the springs in line and spaced apart in the same manner as illustrated in the other Figures. A tie bar 32 is mounted on the second set of springs 26,28, and a control lever 34 is located in the center of the tie bar 32, thus the two axes of movement are perpendicular to each other and movement of the control lever 34 in either or both planes can occur with the centering action of the springs resulting as soon as any force applied to the control lever 34 is removed. FIGS. 7 and 8 show another embodiment of the centering spring mechanism shown in FIGS. 5 and 6 wherein the yoke 20 has a second cross piece 24 at right angles to the first cross piece 18. The second set of springs 26,28 are then positioned in a horizontal plane and the tie bar 32 has an angular configuration with the control lever 24 positioned on a top flange of the tie bar 32. A force on the control lever 24, deflects the springs and when the force is removed, the springs have a centering effect to return the control lever to any upright position.

While two springs are illustrated on each axis, it is apparent to those skilled in the art that more than two springs may be used provided they are in line for each set of springs. Particularly in the embodiments shown in FIGS. 5 to 8, a whole row of springs may be provided as they do not interfere with each other. In the case of the embodiments shown in FIGS. 1 to 4, it would be necessary to leave a space between the springs to prevent interference when the tie bar and yoke is displaced.

Figure 9:
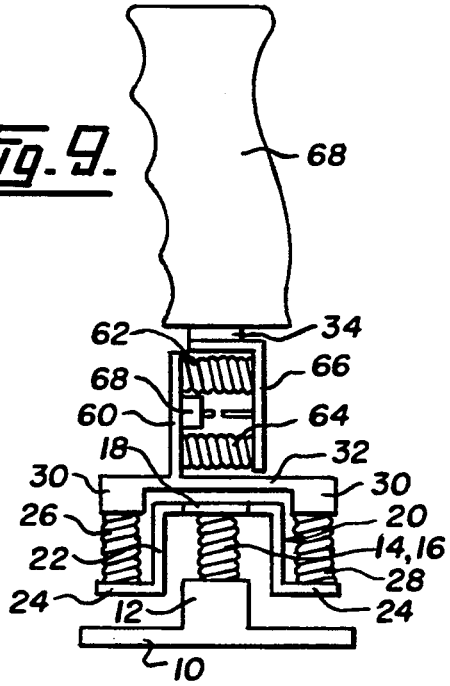
FIG. 9 is a side elevational view showing a still further embodiment of a multi-axial centering spring mechanism including a rotating control lever and an additional set of close wound coil springs, thus giving centering forces in three coincident axis of motion.
Figure 10:
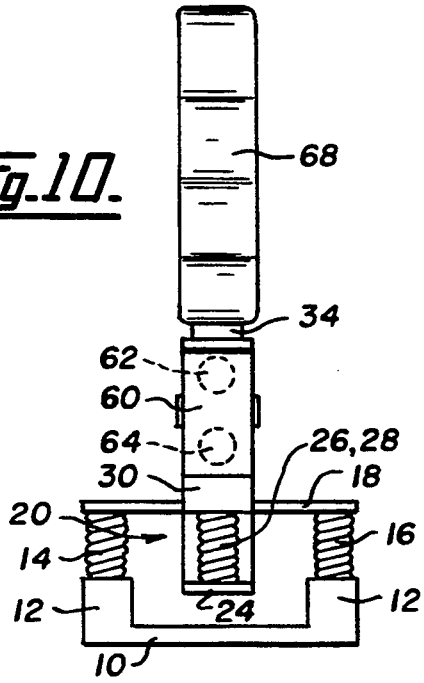
FIG. 10 is an end elevational view showing the centering spring mechanism of FIG. 9.

In FIGS. 9 and 10 a further multi-axial centering spring mechanism is illustrated having three sets of springs. The lower portion of the mechanism with the intersecting axes of rotation is the same as that shown in FIGS. 1 to 3, however on top of the tie bar 32 is provided a tie bar arm 60 extending up slightly eccentric of the mid-point of the intersecting axes and having a third pair of springs 62,64 mounted horizontally and spaced vertically apart. The third set of springs 62,64 are rigidly attached at either end to the tie bar arm 60 and to a lever arm 66 extending up in an angular configuration to join the control lever 34 which in turn is connected to a different type of hand grip 68. The hand grip 68 permits the lever 34 to be twisted about the axis of the control lever 34 in either direction and this in turn deflects the third set of springs 62,64 defined as the vertical axis springs. Thus, a twisting action can occur on the control lever 34. Sensing switches 68 are provided so that a twisting action deflects springs 62,64 and displaces the lever arm 66 relative to the tie bar arm 60. This displacement is sensed by the switches 68 and a signal is produced to control whatever operation the mechanism is used with.

No rotating shafts are needed for the centering spring mechanism and the close wound coil springs which always attempt to straighten up in a single plane provide the only centering force for the two or three axes shown herein.

Various changes may be made to the embodiments shown herein without departing from the scope of the present invention which is limited only by the following claims.

The embodiments of the present invention in which an exclusive property or privilege is claimed are defined as follows:

1. A multi-axial centering spring mechanism comprising:

a first set of at least two close wound coil springs, in line and coupled together in a first plane, mounted on a base means;

a yoke having a first cross piece attached to the first set of springs, such that force applied to the first cross piece, transverse to the first plane, deflects the yoke relative to the base means, and the first set of springs causes the yoke to return to a center position when no force is applied;

the yoke having a second cross piece transverse to the first cross piece;

a second set of at least two close wound coil springs, in line and coupled together in a second plane, mounted on the second cross piece;

a tie bar attached to the second set of springs, such that force applied to the tie bar, transverse to the second plane, deflects the tie bar relative to the yoke, and the second set of springs causes the tie bar to return to a center position when no force is applied, and lever means connected to the tie bar for applying force in the first plane and the second plane.

2. The multi-axial centering spring mechanism according to claim 1 wherein the first set of springs and the second set of springs all have parallel axes.

3. The multi-axial centering spring mechanism according to claim 2 wherein the yoke is arranged in a cross configuration with the first plane perpendicular to and intersecting the second plane at a mid-point, the first set of springs having two springs and the second set of springs having two springs, with the springs positioned equidistant from the mid-point, the lever means in the form of a joy stick extending from the tie bar at the mid-point.

4. The multi-axial centering spring mechanism according to claim 3 wherein the springs are substantially the same size, all having vertical axes and positioned in a substantially horizontal plane.

5. The multi-axial centering spring mechanism according to claim 3 wherein a ball is connected to the tie bar at the base of the joy stick, the ball located in a cage attached to the base means, and permitting restricted movement of the joy stick in both the first plane and the second plane.

6. The multi-axial centering spring mechanism according to claim 1 wherein the yoke has a T-shaped configuration.

7. The multi-axial centering spring mechanism according to claim 1 wherein a first signalling means is associated with the first cross piece of the yoke and the base means to provide a first signal indicating deflection of the yoke relative to the base means, and a second signalling means is associated with the tie bar and the second cross piece to provide a second signal indicating deflection of the tie bar relative to the yoke.

* * * * *